US007127204B2

(12) United States Patent
Satoh et al.

(10) Patent No.: US 7,127,204 B2
(45) Date of Patent: Oct. 24, 2006

(54) BELT FIXING UNIT WITH HEAT-RESISTING RESIN BASE MEMBER AND IMAGE FORMING TONER FOR USE IN THE FIXING UNIT

(75) Inventors: Masahiko Satoh, Funabashi (JP); Masami Tomita, Numazu (JP); Setsuo Soga, Mitaka (JP); Takahiro Yoshikawa, Sagamihara (JP); Toshiharu Hachisuka, Kawasaki (JP); Yasuhiro Kohira, Machida (JP); Ken Omura, Machida (JP); Akira Shinshi, Koto-ku (JP); Naoki Iwaya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/020,205

(22) Filed: Dec. 27, 2004

(65) Prior Publication Data

US 2005/0163543 A1 Jul. 28, 2005

(30) Foreign Application Priority Data

Dec. 25, 2003 (JP) ..... 2003-429895

(51) Int. Cl.
*G03G 15/20* (2006.01)

(52) U.S. Cl. ..... 399/329

(58) Field of Classification Search ..... 399/329; 430/105; 219/216

See application file for complete search history.

(56) References Cited

U.S. PATENT DOCUMENTS 6,652,433 B1 * 11/2003 Ishikawa et al. ..... 492/56
6,858,230 B1 12/2003 Satoh
2002/0159798 A1 * 10/2002 Yamamoto et al. ..... 399/284
2003/0134220 A1 * 7/2003 Emoto et al. ..... 430/109.4
2004/0136763 A1 * 7/2004 Murakami et al. ..... 399/350
2004/0213606 A1 10/2004 Satoh

FOREIGN PATENT DOCUMENTS

EP 0 930 548 A * 7/1999
EP 0 930 548 A1 7/1999
JP 8-44228 2/1996
JP 10-48869 2/1998
JP 10-307496 11/1998
JP 11-149180 6/1999
JP 2002-108094 4/2002
JP 2002-207309 7/2002
JP 2003-029484 1/2003
JP 2003-140381 5/2003
JP 2003-156966 5/2003
JP 2003-241555 8/2003

* cited by examiner

*Primary Examiner*—Susan Lee
(74) *Attorney, Agent, or Firm*—Oblon, Spivak, McClelland, Maier & Neustadt, P.C.

(57) ABSTRACT

A belt fixing unit, an image forming apparatus, and a toner material are disclosed capable of obviating undesirable fixing belt deformation and low image quality. The belt fixing unit includes a fixing roller, a heating roller, a fixing belt, and a pressing roller in contact with the fixing roller to form a fixing nip having the fixing belt intervening there between, the fixing belt including at least a base member formed of a heat-resisting resin having a thickness of 90 μm or smaller and acted upon by a tensile force of 0.49 N/mm or less. The toner is a low-melting point toner formed by subjecting a toner preparatory solution containing at least a prepolymer having a functional group containing a nitrogen atom, a polyester, a colorant and a releasing agent dispersed in an organic solvent to extension and/or crosslinking reactions in an aqueous medium.

19 Claims, 6 Drawing Sheets

$$SF\text{-}1 = \frac{(MXLNG)^2}{AREA} \times \frac{\pi}{4} \times 100$$

$$SF\text{-}2 = \frac{(PERI)^2}{AREA} \times \frac{\pi}{4} \times 100$$

BELT FIXING UNIT WITH HEAT-RESISTING RESIN BASE MEMBER AND IMAGE FORMING TONER FOR USE IN THE FIXING UNIT

CROSS REFERENCE TO RELATED APPLICATIONS

This application claims priority to Japanese application No. 2003-429895, filed on Dec. 25, 2003, the disclosure of which is incorporated by reference herein in its entirety.

BACKGROUND OF THE INVENTION

1. Field of the Invention

The invention relates to a belt fixing unit, an image forming apparatus incorporating the fixing unit, and a toner material suitably used in the fixing unit capable of obviating undesirable fixing belt deformation and concomitant results of partial underdevelopment of electrophotographic images.

2. Discussion of the Background

As to an image fixing process undertaken in an image forming apparatus making use of electrophotography and electrostatic recording, a heat roller fixing unit is known, including a fixing roller having an internal heat source and a pressing roller pressed against the fixing roller. An image transfer sheet carrying an unfixed toner image is conveyed through a fixing nip between the fixing roller and the pressing roller, whereby the toner image is fixed onto the transfer sheet. The toner fixation is therefore carried out by heat transferred from the fixing roller and pressure applied by these rollers.

In the image fixing process, a toner, comprising at least resin materials, is melted to be fixed through either contacting the surface or penetrating into the texture of a transfer sheet under constant pressure.

It is known that the quality of fixed images depends more on the degree of toner melting than on the applied pressure. That is, toner melting conditions primarily determine the resulting quality of a fixed image.

As mentioned above, an unfixed toner image is conveyed in a conventional fixing unit through a fixing nip between the fixing roller and the pressing roller. The fixing nip comprises a pressurized portion at a high temperature generated by a heated roller brought to a close contact with a pressing roller, whereby the process of melting the toner and applying a pressure is performed while conveying a transfer sheet through the fixing nip.

In the fixing process utilized in a conventional image forming apparatus, the sheet conveyance speed generally ranges from 100 to 500 mm/s with the fixing nip width ranging from 4 to 10 mm.

In the heat roller fixing unit, a roller fixing method has been used in which a pressing roller formed with an elastic member on its surface roller is brought into contact with a fixing roller provided internally with a heat source.

Since the fixing nip in the roller fixing method is formed with the rollers contacting each other, the length of the fixing nip is inherently limited, and the linear speed of the fixing and the pressing rollers is relatively slow. Therefore, this method is not suitable for use in a high speed image forming apparatus.

Besides the roller fixing method, a belt fixing method has recently come into widespread use as exemplified by Japanese Laid-Open Patent Application No. 10-307496.

In contrast to the roller fixing method having a limited fixing nip length, the belt fixing method offers the advantage of a wider nip length as an improved feature among other important requirements of the image fixing process.

This fixing nib length corresponds to a range in which a toner is melted to be pressed to a transfer sheet under high temperature and pressure. In order to increase the nip width over a certain level in the roller fixing method, the roller diameter has to be larger, undesirably increasing the overall size of the image forming apparatus.

In the roller fixing method, by contrast, the fixing nip can be formed by utilizing a flexible belt wound around a roller having a relatively small diameter. As a result, a fixing nip having a sufficient width can be formed even in a small space in the apparatus.

The belt fixing method, however, has a drawback, as discussed next.

In a relatively small image forming apparatus of low productivity, small diameter rollers are suitably used. When the image forming apparatus and its units, such as the belt fixing unit in particular, are kept on a stand-by state for a prolonged period time, the fixing belt experiences high tensile stresses, and portions of the belt disposed along respective circumferential surfaces of the rollers may experience plastic deformation.

If the deformation is not easily restored after the system resumes operation, this deformation may cause several problems such as, for example, the irregularity in the rotation of the fixing belt and in the adherence to the heating roller. This may result in uneven heat conduction and concomitant results of partial underdevelopment among others.

This difficulty may seemingly be avoidable by increasing the tensile force applied to the fixing belt. Since the deformation can be released with more ease by increasing the tensile force, this measure may be allowed to some extent. In order to increase the tensile force, the members supporting the fixing belt, such as heating roller, fixing roller and others, also have to be reinforced accordingly.

Such reinforcement, however, will result in the increase not only in the volume of the rollers but also in heat capacity of the apparatus as a whole. As a result, since the time for heating increases, not only accessibility and serviceability worsen, but, the overall energy consumption of the apparatus increases.

It is desirable, therefore, to provide a belt fixing unit, an image forming apparatus incorporating the fixing unit, and a toner material suitably used in the fixing unit capable of obviating undesirable fixing belt deformation and partial underdevelopment of electrophotographic images.

SUMMARY OF THE INVENTION

Accordingly, it is an object of the present invention to provide a belt fixing unit, an image forming apparatus incorporating the fixing unit, and a toner material suitably used in the fixing unit having most, if not all, of the advantages and features of similarly employed units and materials, while reducing or eliminating many of the aforementioned disadvantages.

The above and other object of the present invention are achieved by providing a belt fixing unit for use in an image forming apparatus, comprising a fixing roller, a heating roller, a fixing belt, and a pressing roller disposed in contact with the fixing roller to form a fixing nip having the fixing belt intervening inbetween, in which the fixing belt includes at least a base member formed of a heat-resisting resin having a thickness of 90 μm or smaller and experiences a tensile force of 0.49 N/mm or less.

In addition, the fixing belt is spanned around the fixing roller forming the fixing nip, the heating roller housing a heat source, and at least one other belt supporting members and the heating roller diameter is equal to, or larger than that of the fixing roller, or the at least one other belt supporting member.

In another aspect of the present invention there is provided an image forming apparatus with the belt fixing unit mentioned above, further comprising a developing unit for developing a latent image into a toner image using a toner.

This toner is a low melting point toner formed by subjecting a toner preparatory solution to extension and/or crosslinking reactions in an aqueous medium, the preparatory solution containing at least a prepolymer having a functional group containing a nitrogen atom, a polyester, a colorant and a releasing agent dispersed in an organic solvent.

In still another aspect of the invention, the toner comprises at least one of the following characteristic features:

(1) a volume-averaged particle diameter, Dv, ranging from 3 to 8 μm, and a ratio Dv/Dn ranging from 1.00 to 1.40, where Dn is a number-averaged particle diameter;

(2) first and second shape factors, SF-1 and SF-2, ranging from 100 to 180. The first and second shape factors are defined as:

$$SF\text{-}1=\{(MXLNG)^2/\text{AREA}\}\times 100\Pi/4, \text{ and}$$

$$SF\text{-}2=\{(PERI)^2/\text{AREA}\}\times 100\Pi/4,$$

where MXLNG, AREA, and PERI are the maximum diameter, the area, and the perimeter of a projected, two-dimensional image of the toner, respectively;

(3) a shape approximately spherical; and (4) a shape being approximated by an ellipsoid having a major axis of length r1, a minor axis of length r2, and a thickness r3, in which r1≧r2≧r3, the ratio r2/r1 is in the range of 0.5 to 1.0, and the ratio r3/r2 is in the range of 0.7 to 1.0.

These and other features and advantages of the invention will be more clearly seen from the following detailed description of the invention which is provided in connection with the accompanying drawings.

BRIEF DESCRIPTION OF THE DRAWINGS

In the following drawings, like references numerals will be used to refer to like elements, in which.

DETAILED DESCRIPTION OF PREFERRED EMBODIMENTS

In the detailed description which follows, specific embodiments of a belt fixing unit, an image forming apparatus, and a toner suitably used in the fixing unit are described. It is understood, however, that the present disclosure is not limited to these embodiments. For example, it is appreciated that the use of the structure, component, and properties described may also be adaptable to any form of imaging systems. Other embodiments will be apparent to those skilled in the art upon reading the following description.

Figure 1:
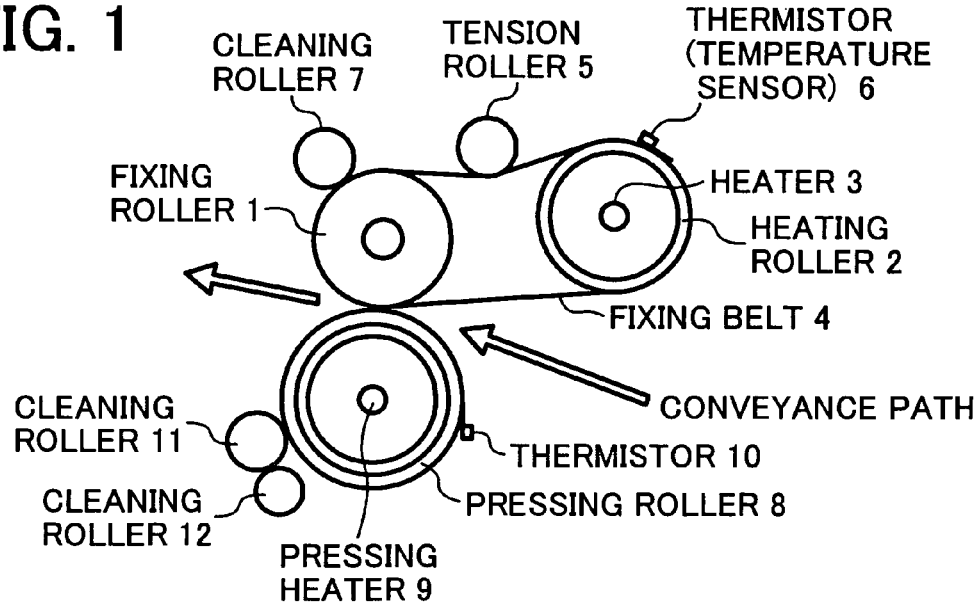
FIG. 1 illustrates the major portions of a belt fixing unit according to one embodiment disclosed herein.

The major portions of a belt fixing unit according to one embodiment of the present invention are shown in FIG. 1.

Referring to FIG. 1, the belt fixing unit include a fixing roller 1, a heating roller 2 housing therein a heater 3, a fixing belt 4 spanned around at least the fixing roller 1 and the heating roller 2, a tension roller 5 disposed so as to be pressed against the fixing belt 4 from the outside for suitably adjusting the tension of the fixing belt 4, a thermistor 6 disposed in the vicinity of heating roller 2 for measuring the temperature of the fixing belt 4, a cleaning roller 7 disposed in the vicinity of fixing roller 1 for cleaning the fixing belt 4, a pressing roller 8 pressed against the fixing roller 1 with the fixing belt 4 disposed therebetween, a pressing heater 9 disposed inside the pressing roller 8 for heating the roller 8, a thermistor 10 for measuring the temperature of the pressing roller 8, and cleaning rollers 11, 12 for cleaning the pressing roller 8.

The fixing belt 4 is spanned around the fixing roller 2 and the heating roller 1 so as to be in close contact with these rollers by the tension exerted by tension roller 5 pressed from the outside, whereby a fixing belt loop is formed. In addition, a fixing nip is formed by pressing the pressing roller 8 against the fixing belt loop at the portion opposing to the fixing roller 1.

The fixing belt 4 is formed of a base member and several layers formed thereon, and the base material is in the form of an endless film consisting of polyimide, i.e., PI belt. The thickness of the base member is suitably adjusted in the range from 50 to 90 μm, which is determined to maintain suitable flexibility and strength, and to minimize or eliminate undulation caused by the tension in practical fixing use. In addition, the base material of the fixing belt 4 may alternatively be formed of PBI (polybenzimidazole).

Elastic layers covering the base material in the fixing belt 4 are formed, each consisting of silicon rubber and fluorocarbon rubber. The thickness of the elastic layer is preferably in the range from 100 to 300 μm. Since the layer of rubber materials has a considerable effect on maintaining modest image qualities, its material composition is selected to have a rubber hardness (JIS-A) of 30 Hs or less.

A surface layer, used as a releasing layer, is formed further on the elastic layers. The surface layer consists of PFA (perfluoroalkoxy resin) or PTFE (polytetrafluoroethylene), having a thickness ranging from 20 to 50 μm. This releasing layer may be formed by either overlaying a tubular structure of the resinous material or forming a film by coating, or burning in the PFA or PTFE in its form of liquid or solid powder.

Being disposed inside the heating roller 2, there utilized as the heater 3 are several heat sources, such as a halogen heater and an infrared heater. Also, a heating resistor may be cited as another heating source.

The temperature of heating roller 2 is detected by a temperature sensor such as the thermistor 6 or other similar device. Based on the measurement results obtained from the detection, the surface temperature of heating roller 2 and fixing belt 4 is controlled by on-off control performed by a control circuit (not shown).

The heating roller 2 is formed of metal such as aluminum and iron. Although a thickness as small as possible is considered favorable, a certain thickness is required in practice to withstand a bending stress exerted by the fixing belt 4 such as 0.4 mm or larger for aluminum and 0.2 mm or larger for iron. The inner face of the heating roller 2 is coated with a black paint, for example, to facilitate further absorption of heat.

The fixing roller 1 is formed of a core material and a surface layer consisting of an elastic body. The former is formed of a rigid body, such as metal, while the latter is formed of an elastic body, such as silicon rubber, for example. More specifically, although the material suitably in use for forming the core is iron and aluminum, a high-strength resin may also be used.

As for the elastic body forming the surface layer, sponge rubber is preferred not only because of its low hardness (50HS or less measured by Asker Type-C Durometer) so that the mechanical load to the fixing belt can be reduced, but also because its thermal conductivity is lower than that of other conventional rubbers, thus minimizing heat dissipation from the belt.

The tension roller 5 is disposed against the fixing belt 4 at the approximately midpoint between fixing roller 1 and heating roller 2. As shown in FIG. 1, this tension roller 5 is pressed from the outside of the fixing belt loop by a pressing member, such as a spring (not shown), toward the fixing belt 4, exerting a tensile force of 0.49 N/mm or less thereto.

Figure 2:
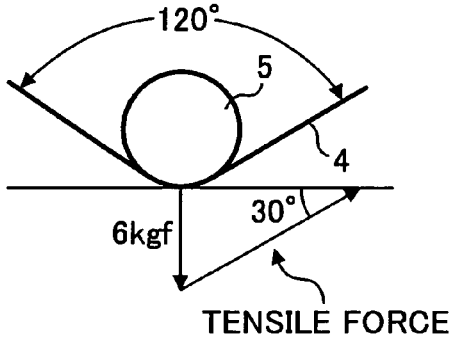
FIG. 2 shows a tensile force exerted by the tension roller.

More specifically, the fixing belt 4 is 240 mm in length and pressed to the tension roller 5 with a tensioning force of 6 kgf (=58.8 N), which is exerted to both sides of the belt, that is, 29.4 N to either side, as illustrated in FIG. 2.

In addition, the length of fixing belt 4 and the spatial arrangement of fixing roller 1 and heating roller 2, as the supporting rollers, are adjusted such that the tension roller 5 the fixing belt 4 to a bend angle of 120°. Then, the total tension exerted to the tension roller 5 is obtained as 6 kgf/sin 30°=12 kgf (=117.6 N), which is 117.6 N/240 mm≈0.49 N per unit length.

As the materials for forming the tension roller 5, there used are a rigid material, such as metal for forming a core member, and a further material, such as heat-resistant felt and silicon rubber for forming a surface layer, which can make use of its elasticity to a certain degree. And, the tension roller 5 is formed of these materials such that the core member is covered with the surface layer.

By providing the thus formed surface layer, several advantages are offered so that no damage is caused by the tension roller 5 to the fixing belt 4 during the application of the tension. A relatively constant tension is maintained even when the accuracy in spatial and tension control decreases to a certain degree, and heat dissipation from the fixing belt 4 can be suppressed because of the magnitude of its thermal conductivity.

Figure 3:
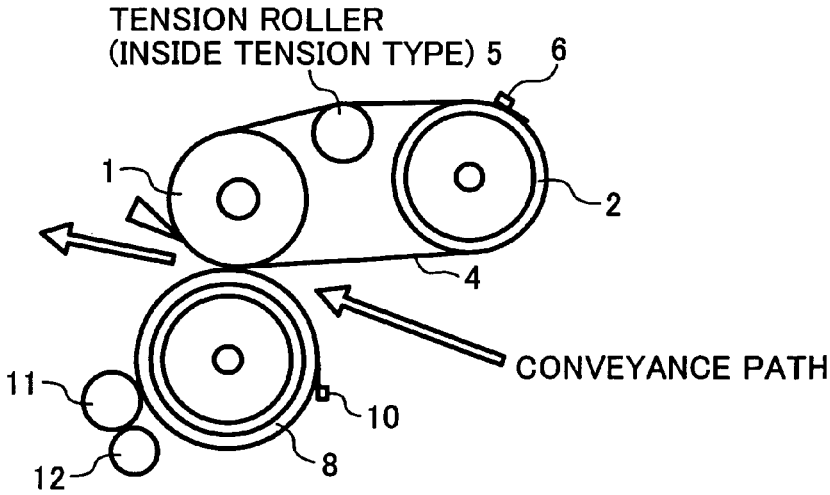
FIG. 3 illustrates the major portions of a belt fixing unit according to another embodiment disclosed herein.

The tension roller 5 may be pressed alternatively from the inside of the fixing belt 4 according to another embodiment disclosed herein, as shown in FIG. 3.

In addition, the heating roller 2 and fixing roller 1 may be disposed so that each is movable in order to achieve the necessary spatial arrangement in place of the aforementioned arrangement with the tension roller 5.

The pressing roller 8 has a structure including a rigid material, such as metal for forming a core member, and a plastic material, such as silicon rubber disposed thereon. As a surface layer, a PFA tube with excellent releasing characteristics, in particular, is preferably disposed, covering the underlying structure.

Figure 4A:
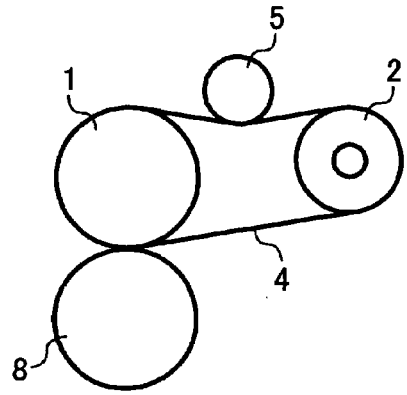
FIGS. 4A and 4B illustrate the fixing belt before and after deformation, respectively.

As mentioned earlier in the background section, when an image forming system and its units, such as the belt fixing unit in particular, are kept on a standby state for a prolonged period of time (FIG. 4A), the fixing belt 4 experiences a high-tensile stress and portions of the belt, which are disposed along respective circumferential surfaces of the rollers, may experience through plastic deformation.

Figure 4B:
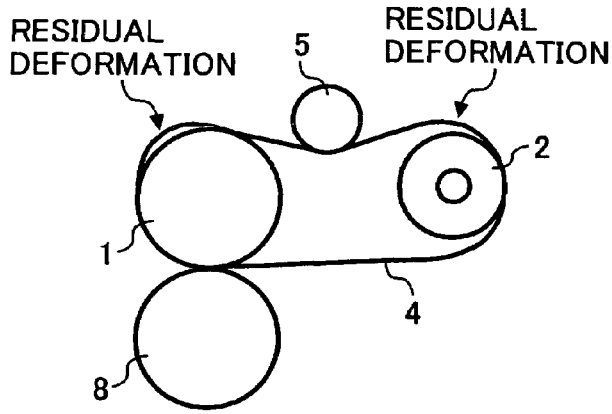

If the deformation is not released easily after the system resumes operation (FIG. 4B), it may cause several difficulties such as, for example, the irregularity in the rotation of the fixing belt 4 and in the adherence to the heating roller 2, which may result in uneven heat conduction and in partial image underdevelopment. By relating the flexibility of the fixing belt 4 to the tensile force applied to the belt 4 and the thickness of the base member, these problems may be eliminated or substantially reduced.

Next, the tensile force applied to the belt 4 and the thickness of base member will be described in more detail.

Figure 5:
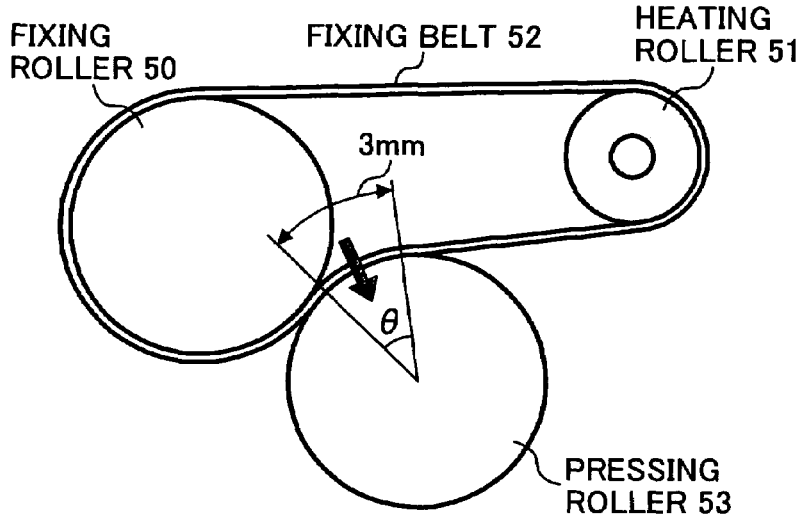
FIG. 5 illustrates the major portions of a known belt fixing unit.

FIG. 5 illustrates, for purposes of comparison, the major portions of an exemplary, belt fixing unit which includes a fixing roller 50, a heating roller 51, a fixing belt 52, and a pressing roller 53.

The following description will be made for the structure of the fixing unit including a Φ20 pressing roller 53, a 3-mm-wide fixing belt 52 disposed in contact with the pressing roller 53 under a 3 kgf (=29.4 N) force exerted by the roller 53, and a 310-mm-long fixing belt 52.

Figure 6:
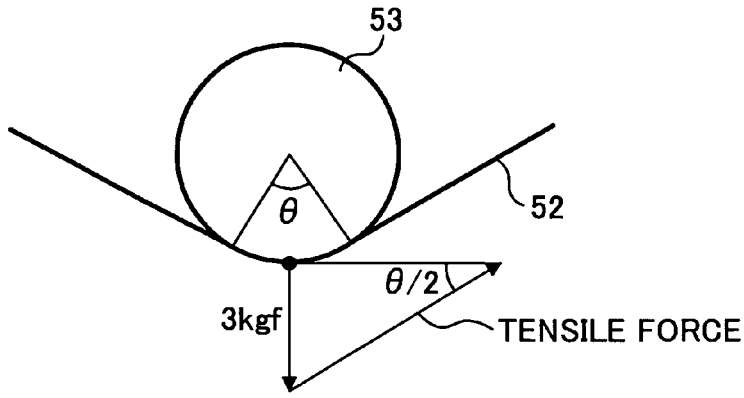
FIG. 6 illustrates the components of a tensile force exerted by the tension roller.

Assuming a 3-mm-long portion of fixing belt 52 to be in close contact with the Φ20 pressing roller 53, the angle θ corresponding to the contact portion, or angle wound around the pressing roller 53, is calculated to be about 17 degree (FIG. 6). Since the force exerted on the fixing belt 52 is assumed to be 3 kgf (=29.4 N), which is 64 kgf/mm (=0.627 N per unit length). Also, a similar force obtained for a Φ40 fixing roller 50 is 120 kgf/mm (=1.18 N per unit length).

In addition, the details of a belt fixing unit is examined concerning the structure illustrated in FIG. 5 under the force of 64 kgf/mm (=0.627 N per unit length).

In a first experiment, a 110-μm-thick PI belt is adopted to a base member of the fixing belt 52. When the belt fixing unit was then kept on a standby state for approximately an hour the deformation residue from the tension applied to the fixing belt 52 caused uneven rotation of the belt when the system resumed operation.

Figure 7:
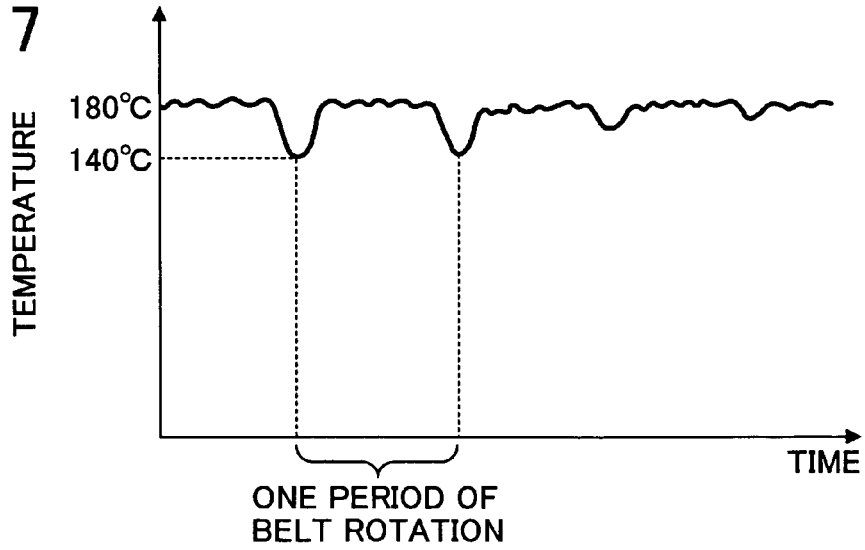
FIG. 7 shows graphically the results obtained from temperature measurements on the fixing belt, indicating a ripple pattern of the temperature in the direction of belt rotation.

As a result, the temperature on the fixing belt 52 was found to fluctuate in the direction of belt rotation, the fluctuation (or ripple) of the temperature was considerable over at least one rotational period as shown in FIG. 7. The temperature fluctuation is cuased by inadequate adherence of the fixing belt 52 to the heating roller 51. Further experiments were performed using several fixing belts 52 of different in belt thicknesses. The results obtained from the experiments are shown in FIG. 8, indicating that the temperature fluctuation is smaller with decreasing belt thickness.

Figure 8:
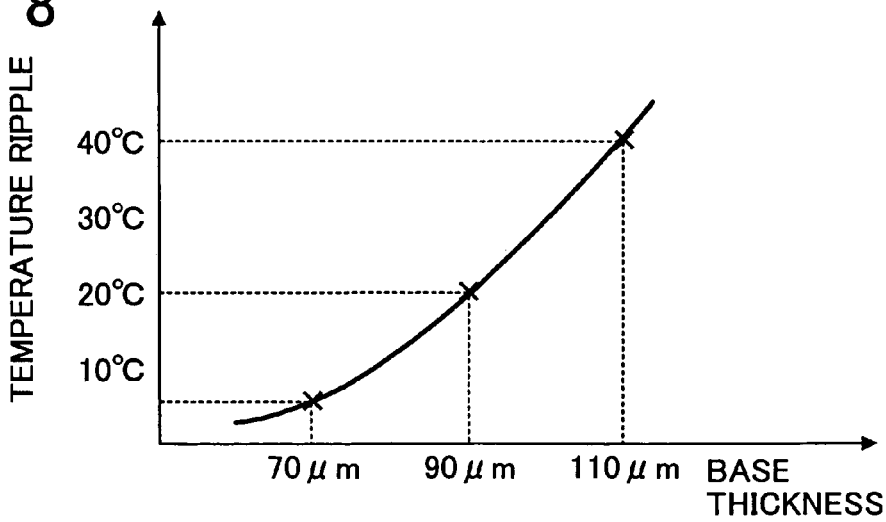
FIG. 8 shows graphically the magnitude of the temperature ripple on the fixing belt for different belt thicknesses, indicating a decrease in temperature ripple as the belt thickness decreases.
Figure 9:
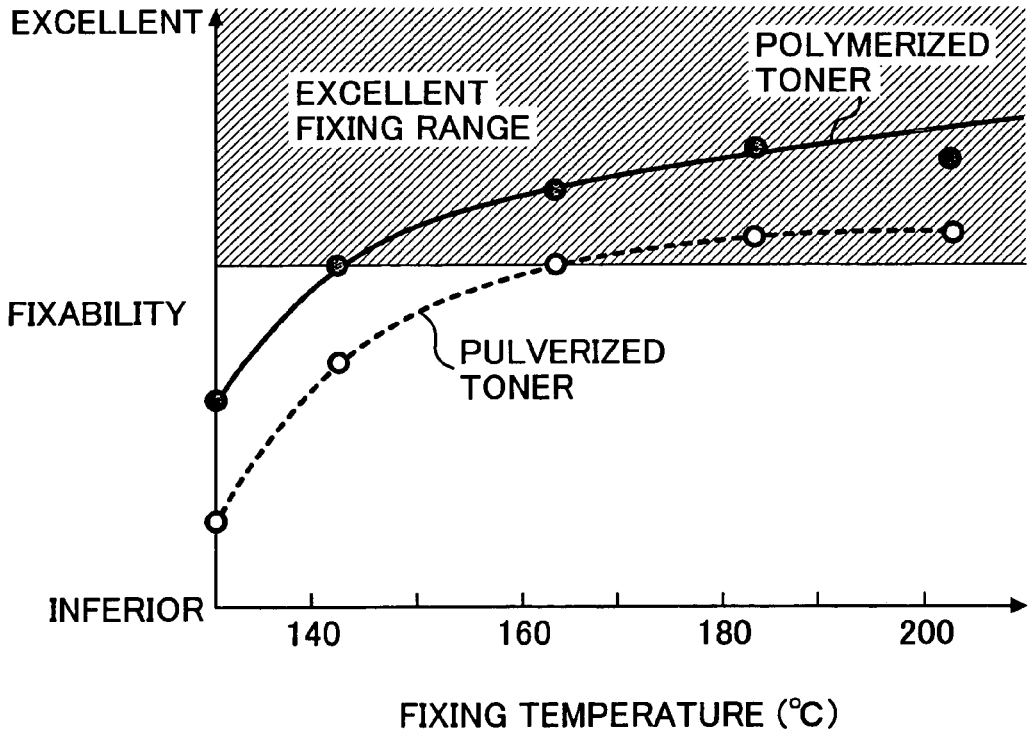
FIG. 9 illustrates the effects of toner quality on fixation temperature.

Since a temperature suitable for image fixing is in the range from 160° to 200° C., based on the results shown in FIG. 8, a belt thickness of 110 μm or less may be used in practice because a temperature ripple of approximately 40° is obtained when the fixing temperature is set to 200° C., while a thickness of 90 μm or less may be used when the fixing temperature is set to 180° C.

Another experiment was performed with a 90-μm-thick base member included in the fixing belt 4 using the belt fixing unit shown FIG. 1. As a result, excellent image fixing results were obtained for this base member thickness. Therefore, a fixing belt having a specified thickness may be suitably chosen in order to retain its flexibility. Additionally, since the fixing belt deformation caused during the standby period of the image forming system is thus alleviated, adequate adherence of the fixing belt to the heating roller is ensured, thereby preventing or minimizing the problem of image underdevelopment.

As another means for eliminating the affect from the deformation caused during the standby period, an embodiment is disclosed in which the diameter of the heating roller 2 is adjusted according to the size of the fixing roller 1.

Since the fixing belt 4 experiences a tensile force during the standby period for being in contact with the fixing roller 1 and heating roller 2, the belt 4 also experiences deformation corresponding to the shape of these rollers 1,2.

If the diameter for both of the fixing roller 1 and heating roller 2 is approximately the same, the overall shape of the fixing belt 4 can be adapted to the circumference of these rollers with relative ease, even in the case when a certain degree of residual deformation is retained.

If the fixing roller 1 is smaller, by contrast, the curvature of belt deformation is smaller for the heating roller 2. In such a case, separation of the fixing belt 4 from the surface of the roller is more difficult to occur at the side of the heating roller 2.

By selecting the heating roller 2 such that its diameter is equal to, or larger than that of the fixing roller 1, temperature ripple effects caused by belt rotation can be reduced by decreasing the base member thickness in the fixing belt 4 even if a certain degree of residual deformation is retained.

Next, the influence of a toner upon the image fixing characteristics is examined by means of both fixing units, one according to the present embodiment and the other with the known structure.

The temperature suitable for the image fixing is in the range from 160° to 200° C. for a toner of the type of conventional pulverized polyester resin (average particle diameter ranging from 6 to 9 μm). Since the temperature ripple on the fixing belt 4 found in the exemplary fixing unit reaches approximately 40° C., as described earlier, the fixing temperature of fixing belt 4 is to be set to 200° C. in order to satisfactorily fix an image at the fixing unit. Otherwise, the lowest temperature may reach below the above-mentioned temperature range required for fixing.

By contrast, since the temperature ripple on the fixing belt 4 found in the fixing unit according to the present embodiment is approximately 20° C., the fixing temperature may be set to 170° C., which is not as high as that for the exemplary fixing unit. In addition, for a polymer-type toner with a low-melting point, which will be described later on, the temperature suitable for the image fixing can be brought to the range from 140° to 200° C. By utilizing such a toner, therefore, the fixing temperature can be set to be lower, i.e., 180° C. in the exemplary fixing unit and 150° C. in the unit of the present embodiment. However, heat dissipation is larger as the set fixing temperature increases, with a concomitant increase in electric power consumption. It should be noted that a reduction in power as much as 200 W can be achieved by decreasing the set fixing temperature from 180° C. to about 150° C. Therefore, the fixing unit of the present embodiment consumes less power than the known, exemplary fixing unit.

Next, a description will be made of a toner suitable for use in the image forming system of the present invention.

In order to form minute image dots of 600 dpi or higher, a volume-averaged, toner particle diameter, Dv, is preferably in the range from 3 to 8 μm.

In addition, the toner preferably has a ratio Dv/Dn ranging from 1.00 to 1.40, where Dn is number-averaged particle diameter of the toner. The ratio Dv/Dn is a parameter representing the degree of scattering, thus, the closer to 1.00 the ratio, the less scattered the particle diameter distribution.

For such toner having a small diameter and less scattered (or sharp) distribution, a uniform charge distribution is achieved over the toner particles and high quality images can be formed without dirty background and transfer efficiency is improved in the image formation of the electrostatic transfer type without causing a void in transferred image.

Furthermore, it has been found that the toner type has a considerable effect on fixation properties. That is, the polymer-type toner according to one of the embodiments has better fixation properties than toners formed by a known pulverization method.

Figure 10A:
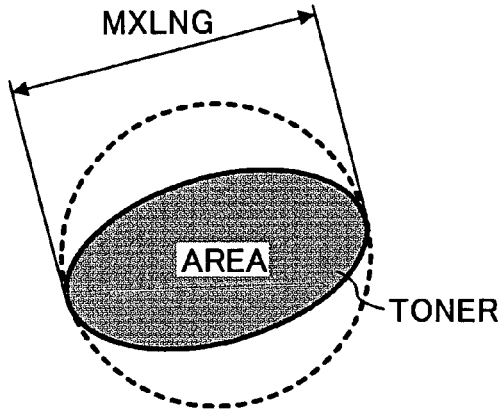
FIGS. 10A and 10B diagrammatically illustrate the shape factors SF-1 and SF-2 of toner particles.
Figure 10B:
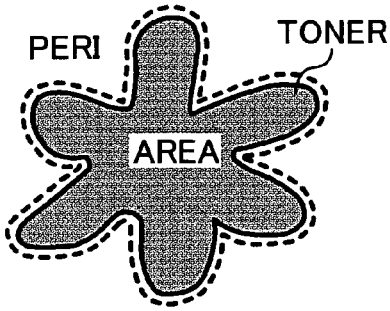

Additionally, the toner shape factors SF-1 and SF-2 are preferably between 100 and 180. FIGS. 10A and 10B diagrammatically illustrate how the toner shape factors SF-1 and SF-2 are defined.

SF-1 is indicative of the degree of roundness of the toner shape as expressed by the relation (1), in which the square of the maximum length MXLNG of the toner image in its two-dimensional projection is divided by the area AREA of the image, and then multiplied by 100Π/4 (FIG. 10A), i.e., $$SF\text{-}1=\{(MXLNG)^2/\mathrm{AREA}\}\times 100\Pi/4 \quad (1).$$

The shape of the toner is a sphere when the SF-1 value is 100, while the shape becomes more irregular as the value increases.

In addition, the factor SF-2 is indicative of the degree of irregularity (or ruggedness) of the toner shape as expressed by the relation (2), in which the perimeter, or PERI, of the toner image in its two-dimensional projection is divided by the area AREA of the image, and then multiplied by 100Π/4, i.e., $$SF\text{-}2=\{(PERI)^2/\mathrm{AREA}\}\times 100\Pi/4. \quad (2).$$

The shape of the toner has no ruggedness when the SF-1 value is 100, while the shape of the surface becomes more rugged as the value increases.

Specifically, measurements and analyses of the shape factors were carried out by photographing toner particles with a scanning electron microscope (S-800 from Hitachi Co., Ltd.) and subsequently analyzing the photographs on an image analyzing apparatus (LUSEX3 from Nicore Co., Ltd.).

As the toner shape comes closer to a sphere, the contact between toners, and between a toner and the photoreceptor, is made through the point contact. As a result, the attractive force acting between toner particles decreases, whereby the transfer efficiency increases. If at least one of SF-1 and SF-2 exceeds 180, the toner has an undesirable shape because of decreased transfer efficiency.

The toner of the present invention for use in an electrophotographic image forming apparatus is prepared by performing, in an aqueous medium, the crosslinking and/or extension reaction on toner preparatory solution containing several ingredients, including at least a prepolymer having a functional group containing a nitrogen atom, a polyester, a colorant and a releasing agent dispersed in an organic solvent.

The toner composition and the method of preparation will be described next.

The polyesters used for the preparation of the base polyester are formed by a condensation and polymerization reaction of a polyol and a polycarboxylic acid.

Examples of a polyol include a diol and a tri- or more polyhydric alcohol. Either the diol alone or a mixture thereof with a small amount of tri- or more polyhydric alcohol is preferably used.

Specific examples of the diol include alkylene glycols, such as ethylene glycol, 1,2-propylene glycol, 1,3-propylene glycol, 1,4-butanediol, and 1,6-hexanediol; alkylene ether glycols, such as diethylene glycol, triethylene glycol, dipropylene glycol, polyethylene glycol, polypropylene glycol, and polytetramethylene ether glycol; alicyclic glycols, such as 1,4-cyclohexane dimethanol, and hydrogenated bisphenol A; bisphenols, such as bisphenol A, bisphenol F, and bisphenol S; alkylene oxide adducts (e.g., ethylene oxide, propylene oxide and butylene oxide adducts) of the abovementioned alicyclic diols; and alkylene oxide adducts (e.g., ethylene oxide, propylene oxide and butylene oxide adducts) of the above bisphenols.

Among these compounds, alkylene glycols having 2 to 12 carbon atoms and alkylene oxide adducts of bisphenols are preferably used. Particularly preferred is a mixture of alkylene glycols having 2 to 12 carbon atoms with alkylene oxide adducts of bisphenols.

Examples of the tri- or more polyhydric alcohol include polyhydric aliphatic alcohols having 3 or more groups, such as glycerin, trimethylolpropane, trimethylolethane, pentaerythritol, and sorbitol; phenol compounds having 3 or more hydroxyl groups, such as trisphenol PA, phenol novolak, and cresol novolak; and alkylene oxide adducts of the abovementioned phenol compounds having 3 or more hydroxyl groups.

The polycarboxylic acid may be a dicarboxylic acid, or a tri- or more polybasic carboxylic acid. The use of a dicarboxylic acid or a mixture of a dicarboxylic acid with a small amount of a tri- or more polybasic carboxylic acid is preferred.

Preferred examples of the dicarboxylic acid include alkyldicarboxylic acids such as succinic acid, adipic acid, and sebacic acid; alkenylene dicarboxylic acids, such as maleic acid and fumaric acid; and aromatic dicarboxylic acids, such as phthalic acid, isophthalic acid, terephthalic acid, and naphthalene dicarboxylic acid.

Above all, alkenylene dicarboxylic acids having 4 to 20 carbon atoms and aromatic dicarboxylic acids having 8 to 20 carbon atoms are preferably used.

Preferred examples of the tri- or more polybasic carboxylic acid include aromatic polycarboxylic acids having 9 to 20 carbon atoms such as trimellitic acid and pyromellitic acid. The polycarboxylic acids may be formed by reacting lower alkyl esters, such as methyl ester, ethyl ester and isopropyl ester, with the polyol.

The ratio for forming the polyester, [OH]/[COOH] of the equivalent of the hydroxyl groups [OH] to the equivalent of the carboxyl groups [COOH], is generally in the range from 2:1 to 1:1, preferably from 1.5:1 to 1:1, more preferably from 1.3:1 to 1.02:1.

The condensation and polymerization reaction of the polyol and polycarboxylic acid is performed in the presence of a known esterification catalyst such as tetrabutoxytitanate or dibutyltin oxide at a temperature ranging from 150 to 280 C under a reduced pressure while removing water produced in-situ, if necessary, to obtain a polyester having a hydroxyl group.

The polyester has a hydroxyl value of at least 5. Also, it has in general an acid value from 1 to 30, and preferably from 5 to 20.

The toner with the specified acid value has improved characteristics in negative charging capability, compatibility with, and fixing to, copy paper and toner, and low temperature fixation properties. However, with an acid value of over 30 adverse effects are observed, such as deteriorating charging capability and environmental stability.

The polyester generally has a weight-averaged molecular weight from 10,000 to 400,000, preferably from 20,000 to 200,000.

A weight-averaged molecular weight less than 10,000 may adversely affect the anti-hot offset properties of the toner. And, its low temperature fixation properties are worsened with molecular weight values over 400,000.

In addition to the non-modified polyester formed by the condensation and polymerization reaction, the urea-modified polyester may preferably be contained. The urea-modified polyester is obtained by reacting a carboxy or hydroxyl group at the terminus of the polyester obtained by the above-mentioned condensation and polymerization reaction with the polyisocyanate to form the isocyanate group containing a polyester prepolymer, and further reacting with the amines through crosslinking and/or extension.

Suitable examples of a polyisocyanate compound for use in the present invention are aliphatic polyisocyanates, such as tetramethylene diisocyanate, hexamethylene diisocyanate, and 2,6-diisocyanate methylcaproate; alicyclic polyisocyanates, such as isophorone diisocyanate and cyclohexylmethane diisocyanate; aromatic diisocyanate, such as xylylene diisocyanate, tolylene diisocyanate, diphenylmethane diisocyanate, and $\alpha,\alpha,\alpha',\alpha'$-tetramethylxylylene diisocyanate; isocyanurates; the abovementioned polyisocyanates blocked with phenol derivatives or caprolactams; and mixtures thereof.

The ratio of the polyisocyanate compounds, which is represented by the parameter [NCO]/[OH] of the equivalent of the isocyanate groups [NCO] to the equivalent of the hydroxyl groups [OH] of the polyester, is generally in the range from 5:1 to 1:1, preferably from 4:1 to 1.2:1, more preferably from 2.5:1 to 1.5:1. A [NCO]/[OH] ratio exceeding 5:1 tends to adversely affect low temperature fixation properties of the resulting toner. A [NCO]/[OH] ratio less than 1 tends to adversely affect anti-hot offset properties.

The isocyanate group containing polyester prepolymer generally has a content of the polyisocyate unit in the range from 0.5 to 40% by weight, preferably from 1 to 30% by weight, more preferably from 2 to 20% by weight. An isocyanate group content of less than 0.5% tends to adversely affect anti-hot offset properties and to pose a difficulty in simultaneously obtaining satisfactory low temperature fixation properties and heat-resisting preservation properties of the resulting toner. While an isocyanate group content that exceeds 40% by weight tend to adversely affect the low temperature fixation properties of the resulting toner.

The average number of the isocyanate groups contained in the prepolymer molecule is generally at least 1, preferably 1.5 to 3, more preferably 1.8 to 2.5. Too small an isocyanate group number, such as less than 1, will result in a urea-modified polyester having an excessively small molecular weight so that the anti-hot offset properties of the toner will be adversely affected.

Examples of the amine to be reacted with the isocyanate group containing polyester prepolymer include diamines (B1), polyamines (B2) having three or more amino groups, aminoalcohols (B3), aminomercaptans (B4), amino acids (B5), and derivatives (B6) either blocked or protected thereof such as B1 through B5.

Specific examples of suitable diamines include aromatic diamines, such as phenylenediamine, diethytoluenediamine, and 4,4'-diaminodiphenylmethane; alicyclic diamines, such as 4,4'-diamino-3,3-dimethylcyclohexylmethane, diaminocyclohexane, and isophoronediamine; and aliphatic diamines, such as ethylenediamine, tetramethylenediamine, and hexamethylenediamine.

Examples of suitable polyamines having 3 or more amino groups include diethylenetriamine and triethylenetetramine. Examples of suitable aminoalcohols are ethanolamine and hydroxyethylaniline. Examples of suitable aminomercaptans are aminoethylmercaptan and aminopropylmercaptan. Examples of suitable amino acids are aminopropionic acid and aminocaproic acid.

Suitable examples of the derivatives having blocked amino groups of the abovementioned B1 through B5, are ketimines formed by reacting the amines with ketones such as acetone, methyl ethyl ketone, and methyl isobutyl ketone. Oxazolidine compounds may be also cited as the blocked derivatives.

Particularly preferred among the amines are diamines either individually or in combination with a small amount of polyamines.

The ratio of amines with the isocyanate group containing polyester prepolymer, which is represented by $[NCO]/[NH_x]$ of the equivalent of the isocyanate groups [NCO] of the prepolymer to the equivalent of the amino groups $[NH_x]$ of the amine, is generally in the range from 1:2 to 2:1, preferably from 1.5:1 to 1:1.5, and more preferably from 1.2:1 to 1:1.2.

A $[NCO]/[NH_x]$ ratio of over 2:1 or less than 1:2 will result in a lowered molecular weight for urea-modified polyester so that the anti-hot offset properties of the toner will be adversely affected. The urea-modified polyester may contain a urethane bond, where relevant. The molar ratio of urea bond content to urethane bond is generally in the range from 100:0 to 10:90, preferably from 80:20 to 20:80, and more preferably from 60:40 to 30:70. A number of urea bond below 10 mole % may adversely affect the anti-hot offset properties of toner.

The modified polyester, such as urea-modified polyester for use in the present invention, may be prepared by a one-shot method.

The method of producing the urea-modified polyester is as follows, for example. A polyol and a polyacid are reacted with each other in the presence of a known esterification catalyst such as tetrabutoxytitanate or dibutyltin oxide at a temperature from 150° to 280° C. The reaction may be carried out under a reduced pressure while removing water produced in-situ, where relevant. The resulting hydroxyl group containing polyester is reacted with a polyisocyanate at a temperature ranging from 40° to 140° C. to obtain an isocyanate-containing prepolymer. The prepolymer is then reacted with amines at a temperature ranging from 40° to 140° C. to obtain urea-modified polyester.

During the formation of the polyisocyanate and the reaction between the prepolymer and amines, any solvent inert to the polyisocyanate may be used, where relevant.

Examples of such solvents include aromatic solvents, such as toluene and xylene; ketones, such as acetone, methyl ethyl ketone, and methyl isobutyl ketone; esters, such as ethyl acetate; amides, such as dimethylformamide and dimethylacetamide; and ethers, such as tetrahydrofuran.

In addition, during the crosslinking and/or extension reaction with the prepolymer and amines, a chain extension terminator may be used, if desired, to control the molecular weight of the resulting urea-modified polyester. Preferred examples of the chain extension terminator include monoamines, such as diethylamine, dibutylamine, butylamine, and laurylamine; and blocked monoamines, such as ketimine compounds.

The urea modified polyester generally has a weight-averaged molecular weight of at least 10,000 preferably from 20,000 to one million, more preferably from 30,000 to one million. A weight-averaged molecular weight of less than 10,000 may adversely affect the anti-hot offset properties of toner.

When the modified polyester is used in combination with non-modified polyester as the toner binder, its number-averaged molecular weight is not specifically limited, but may be arbitrarily determined in view of the above weight-average molecular weight.

When the modified polyester is used by itself as the binder, however, its number-averaged molecular weight is generally from 20,000 to 15,000, preferably 2,000–10,000, and more preferably 2,000 to 8,000. A number-averaged molecular weight above 20,000 may adversely affect low temperature fixation properties of the resulting toner as well as gloss of color toner images.

The modified polyester may preferably be used as the toner binder in combination with a non-modified polyester rather than the modified polyester alone for reasons of low-temperature fixation properties of the toner and improved gloss of the toner images. The PE may be polycondensation products obtained from a polyol and a polycarboxylic acid. Suitable polyols and polycarboxylic acids are as described previously with reference to the MPE. Incidentally, the non-modified polyester may include polyester modified by a chemical bond other than the urea bond. It is preferred that the non-modified polyester be compatible at least partially with the modified polyester for reasons of low fixation properties and anti-hot offset properties of the toner. It is preferable that the non-modified polyester have a composition similar to that of the modified polyester.

The weight ratio of the non-modified to the modified polyester is generally from 20:80 to 95:5, preferably 70:30 to 95:5, more preferably 75:25 to 95:5, and more preferably 80:20 to 93:7. For a weight ratio of the modified polyester below 5% is disadvantageous on the ground of deteriorating anti-hot offset properties, heat preservation, and low temperature fixation properties.

The toner binder containing the modified and non-modified polyesters used in the present invention generally has a glass transition point (Tg) from 45° to 65° C., preferably 45° to 65° C. A glass transition point of less than 45 C tends to cause deterioration of heat preservation properties, while too high a glass transition point of over 65° C. causes the deterioration in low temperature fixation properties.

In addition, because of the presence of the modified polyester more on the surface area of the toner, the dry toner of the present invention tends to exhibit superior heat resistance and preservation properties even with its relatively low glass transition point.

(Colorant)

As the colorant utilized in the image developing toner of the present invention, any of pigments and dyes conventionally known can be employed.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanent Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and other similar compounds.

These dyes and pigments are used individually or in combination. The content of a coloring agent in the toner in the present invention is preferably from about 1 to 15% by weight, and more preferably 3 to 10% by weight, based on the weight of the toner.

The colorant may also be used with a resin binder to form a master batch for producing the toner.

As the binder resin for forming, and kneading with the master batch, several compounds are utilized, including homopolymers of styrene or substituted styrenes, such as polystyrene, poly-p-chlorostyrene, and polyvinyltoluene; copolymers thereof with vinyl compounds, such as styrene-propylene copolymer, styrene-vinyltoluene copolymer, styrene-vinylnaphthalene copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; epoxy resin; epoxy polyole resin; polyurethane; polyamide; polyvinyl butyral; polyacrylic acid resin; polyvinylbutyl butyral; polyacrylic resin; rosin; modified rosin; terpene resin; phenolic resin; aliphatic hydrocarbon resin; alicyclic hydrocarbon resin; aromatic petroleum resin; chlorinated paraffin; and paraffin wax. These polymers can be used individually or in combination.

(Charge Controlling Agent)

The toner of the present invention may contain a charge-controlling agent where relevant. Any charge controlling agent generally known for use in the electrophotographic toner formation may be used for the purpose of the present invention.

Examples of such charge controlling agents include a nigrosine dye, a triphenylmethane dye, a chromium-containing metal complex dye, a molybdic acid chelate pigment, a rhodamine dye, an alkoxyamine, a quaternary ammonium salt (including a fluorine-modified quaternary ammonium salt), alkylamide, phosphorus and a phosphorus-containing compound, tungsten and a tungsten-containing compound, a fluorine-containing activator material, and metallic salts of salicylic acid and derivatives thereof.

Specific examples of the charge controlling agents include Bontron 03 as Nigrosine dye, Bontron P-51 as quaternary ammonium salt, Bontron S-34 the metal-containing azo dye, E-82 as oxynaphthoic acid type metal complex, E-84 as salicylic acid type metal complex and E-89 as phenol type condensation product, which are manufactured by Orient Chemical Industry Co., Ltd.; TP-302 and TP-415 both as quaternary ammonium salts molybdenum complex, which are manufactured by Hodogaya Chemical Co., Ltd.; Copy Charge PSY VP2038 as quaternary ammonium salts, Copy Blue PR as triphenylmethane derivative, Copy Charge NEG VP2036 and Copy Charge NX VP434 both as quaternary ammonium salts, which are manufactured by Hoechst AG; LRA-901 and LR-147 as boron complex, which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

Preferably used herein are the compounds which tend to endow the toner with negative electric charges.

The amount of charge control agent for use in the color toner may be determined in accordance with the kind of binder resin to be employed, the presence or absence of additives, and the preparation method of the toner in inclusive of the method of dispersing the toner composition.

Although the amount of charge control agent therefore cannot be determined uniquely, it is preferable the amount is in the range from 0.1 to 10 parts by weight, and more preferably in the range from 0.2 to 5 parts by weight, per 100 parts by weight of the binder resin.

An amount of 10 parts or larger by weight results in several negative effects, such as too large chargeability with suppressing the effect of the charge control agent and the decrease in fluidity of developer caused by the increase in electrostatic attraction between the developing roller, thereby lowering the image density (Releasing Agent)

As a material having suitable characteristics as a releasing agent at the interfaces between toner particles and fixing roller, a low-melting point wax having a melting point ranging from 50° to 120° can be used so that hot offset can be prevented without coating a known releasing agent such as oil.

Examples of such wax compositions include, but are not limited to, vegetable waxes, such as carnauba wax, cotton wax, sumac wax, and rice wax; animal waxes, such as bee wax and lanoline; mineral waxes, such as ozokerite; and petroleum waxes, such as paraffin wax, microcrystalline, and petrolatum. In addition to these natural waxes, there included are synthesized hydrocarbon waxes, such as Fischer-Tropsch wax and polyethylene wax; and synthesized waxes, such as ester, ketone and ether.

Further, 1,2-hydroxytearic acid amide, stearic acid amide, phtahlic anhydride imide, amides of aliphatic acids, such as chlorinated hydrocarbon acids, and crystalline low molecular weight polymers having a long alkyl group in a side chain thereof, such as homopolymers of acrylates (e.g., poly-n-stearyl methacrylate and poly-n-lauryl methacrylate) and copolymers of acrylates (e.g., n-stearyl acrylate—ethyl methacrylate copolymers) can also be used as the release agent.

The charge controlling agent and releasing agent may be subjected to melting and kneading together with the master batch and binder resin, or alternatively, dissolving or dispersing in an organic solvent.

(External Additive)

Inorganic fine particles as an external additive may be suitably used to improve the fluidity, developing efficiency, and chargeability of the toner by being attached to outer surfaces of the toner particles.

The inorganic fine particles preferably have a primary particle diameter ranging from 5 nm ($5\times10^{-3}$ μm) to 2 μm, more preferably 5 nm to 0.5 μm, and a BET specific surface area in the range from 20 to 500 $m^2/g$. The amount of inorganic fine particles is generally in the range from 0.01 to 5% by weight and preferably from 0.01 to 2% by weight.

Specific examples of the inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Among the particles, in particular, the combination of hydrophobic silica and tin oxide particulates is preferably used as a fluidity additive. When these particles having an average particle size of 50 nm or smaller are used for dispersing and mixing several advantageous effects can be achieved, such as excellent image qualities without undesirable white spots and a concomitant decrease in residual toner particles after image transfer. These effects are caused by satisfactory adhesion between the fluidity additive and the toner by the combination, which is caused by a considerable increase in the strength of electrostatic and Van der Waals forces, large enough to prevent the fluidity additive be separated from the toner during the steps of stirring and mixing the latter in a copying apparatus for attaining a desirable level of toner charging.

Titanium oxide particulates are known to have excellent environmental stability and image density stability, while they have a trend of worsening the rising characteristics for toner charging. This trend may be considered to affect adversely when the amount of titanium oxide addition becomes greater than that of silica particulates. However, the deteriorative effect for the addition of hydrophobic silica and tin oxide particulates is not eminent in the range from 0.3 to 1.5% by weight so that the rising characteristics of toner charging is not affected so much. As a desirable result, rising characteristics are obtained and stable image qualities are assured over the repletion of copying steps.

Toner composition according to the present invention may be prepared as follows, in which the description is intended to be illustrative but not limiting.

(Preparation of Toner)

1) A toner preparatory solution is prepared by dispersing in organic solvent several ingredients, such as a coloring agent, non-modified polyester, isocyanate group-containing polyester prepolymer, and releasing agent.

The organic solvent in use for the preparation is preferably volatile having a boiling point of 100° C. or lower from the view point of the ease of toner materials removal after their formation.

Specific examples of the organic solvents include toluene, xylene and benzene, carbon tetrachloride, methylene chloride, 1,2-dichloroethane, 1,1,2-trichloroethane, trichloroethylene, chloroform, monochlorobenzene, dichlorloethylidene, methyl acetate, ethyl acetate, methyl ethyl ketone, and methyl isobutyl ketone. These solvents may be used individually or in combination.

Particularly, preferably used in the present invention are aromatic hydrocarbons, such as toluene and xylene; and halogenated hydrocarbons such as methylene chloride, 1,2-dichloroethane, chloroform, and carbon tetrachloride.

The amount of the organic solvent is generally from 0 to 300 parts by weight, preferably from 0 to 100 parts by weight, and more preferably from 25 to 75 parts by weight, per 100 parts by weight of the polyester prepolymer.

2) Thereafter, the toner preparatory solution is emulsified in an aqueous medium in the presence of a surfactant and resin particulates.

The aqueous medium may include water alone, or alternatively several organic solvents such as alcohols (methanol, isopropyl alcohol, ethylene glycol), dimethylformamide, tetrahydrofuran, cellosolves (methycellsolve and others), and low ketones (acetone and methyl ethyl ketone).

The amount of the aqueous medium is generally from 50 to 2000 parts by weight, and preferably from 100 to 1000 parts by weight per 100 parts by weight of the toner preparatory solution.

An amount less than 50 parts by weight tends to pose a difficulty in the dispersion of the toner preparatory solution so that toner particles with desirable diameter cannot be obtained, while an amount exceeding 20,000 parts by weight is uneconomical.

In order to improve the degree of dispersion of the toner preparatory solution in the aqueous medium, a dispersing agent is appropriately added, including a surfactant and resin particulates.

Examples of the surfactants include anionic surfactants, such as a salt of alkylbenzensulfonic acid, a salt of alpha-olefinsulfonic acid, and a phosphoric ester; cationic surfactants, such as amine surfactants (including alkylamine salt, aminoalcohol fatty acid derivative, polyamine fatty acid derivative, and imidazoline), and quaternary ammonium salt surfactants (including alkyl trimethylammonium salt, dialkyl dimethylammonium salt, dialkyl dimethylammonium salt, pyridium salt, alkyl isoquinolinium salt, and benzethonium chloride); nonionic surfactants, such as a fatty amide derivative and polyhydric alcohol derivative; and amphoteric surfactants, such as alanine, dodecyl di(aminoethyl)glycine and di(octylaminoethyl)glycine, and N-alkyl-N,N-dimethylammoniumbetaine.

In addition, small amounts of a surfactant having a fluoroalkyl group can achieve satisfactory effects.

Suitable anionic surfactants having a fluoroalkyl group include fluoroalkylcarboxylic acids having from 2 to 10 carbon atoms and their metal salts, perfluorooctanesulfonylglutamic acid disodium salt, 3-[ω-fluoroalkyl (C6–C11) oxy]-1-alkyl (C3–C4) sulfonic acid sodium salts, 3-[ω-fluoroalkanoyl (C6–C8)—N-ethylamino]-1-propanesulfonic acid sodium salts, fluoroalkyl (C11–C20) carboxylic acids and their metal salts, perfluoroalkylcarboxylic acids (C7–C13) and their metal salts, perfluoroalkyl (C4–C12) sulfonic acid and their metal salts, perfluorooctanesulfonic acid diethanolamide, N-propyl-N-(2-hydroxyethyl)perfluorooctanesulfonamide, perfluoroalkyl (C6–C10) sulfoneamidopropyl trimethylammonium salts, perfluoroalkyl (C6–C10)—N-ethylsulfonylglycine salts, and monoperfluoroalkyl (C6–C16) ethylphosphoric acid esters.

Trade names of the anionic surfactants having a perfluoroalkyl group are Surflon S-111, S-112 and S-113 (manufactured by Asahi Glass Co., Ltd.), Florard FC-93, FC-95, FC-98 and FC-129 (manufactured by Sumitomo 3M Ltd.), Unidine DS-101 and DS-102 (manufactured by Daikin Co., Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos Co., Ltd.).

Specific examples of suitable cationic surfactants having a fluoroalkyl group include primary, secondary or tertiary aliphatic amine salts; aliphatic quaternary ammonium salts such as perfluoroalkyl (C6–C10) sulfonamidopropyltrimethyl-ammonium salts; benzalkonium salts; benzethonium chloride; pyridinium salts; and imidazolinium salts. Trade names of the cationic surfactants are Surflon S-121 (Asahi Glass Co., Ltd.), Florard FC-135 (manufactured by Sumitomo 3M Ltd.), Unidine DS-202 (manufactured by Daikin Co.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

Fine particles of polymer may be added to stabilize the toner particles prepared in the aqueous medium. The particles are preferably added so that its coverage ratio on the surface area of the toner is in the range from 10 to 90%.

Examples of suitable resin particles include polymethyl methacrylate particulates with the particle size of 1 or 3 μm, polystyrene particulates of the size of 0.5 or 2 μm, and poly(styrene-acrylonitrile) particulates of the size of 1 μm. Their trade names are PB-200H (by Kao Co., Ltd.), SGP (Sohken Co., Ltd.), Techno-Polymer SB (Sekisui Chemical Industry Co., Ltd.), SGP-3G (Sohken Co., Ltd.) and Miro-Pearl (Sekisui Fine Chemical Co., Ltd.).

In addition, dispersants of inorganic compounds may also be used, including tricalcium phosphate, calcium carbonate, titanium oxide, colloidal silica, and hydroxyapatite.

The dispersing agent can be prepared by stabilizing dispersed droplets utilizing macromolecular protective colloids, which may be used in combination with the aforementioned resin particulates and inorganic dispersants. By way of examples of such agents, there cited are acids, such as acrylic acid, methacrylic acid, α-cyanoacrylic acid, α-cyanomethacrylic acid, itaconic acid, crotonic acid, fumaric acid, maleic acid, and maleic anhydride; methacrylic monomers having a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide; vinyl alcohols or ethers of vinyl methyl ether, such as vinyl ethyl ether and vinyl propyl ether, esters of vinyl alcohol with a carboxylic acid such as vinylacetate, vinylpropionate, and vinyl butyrate; amides such, as acrylamide, methacrylamide, diacetoneacrylamide, and their methylol compounds; acid chloride compounds, such as acrylic acid chloride and methacrylic acid chloride; homopolymers and copolymers of compounds having a nitrogen atom or a heterocyclic ring including a nitrogen atom, such as vinyl pyridine, vinyl pyrrolidone, vinyl imidazole, and ethylene imine; polyoxyethylene compounds, such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds, such as methyl cellulose, hydroxyethyl cellulose, and hydroxypropyl cellulose.

The method of dispersing the toner ingredients into the aqueous medium is illustrated as follows, in which the description is intended to be illustrative, but not limiting.

The method of dispersion may be carried out using any desired dispersing device, such as a low speed shearing type dispersing device, a high speed shearing type dispersing device, an abrasion type dispersing device, a high pressure jet type dispersing device, or an ultrasonic-type dispersing device.

The high speed shearing type dispersing device is preferably used for the reasons of acquiring dispersed toner particles having a diameter ranging from 2 to 20 μm. The high speed shearing type dispersing device is not highly restrictive, but operated in general at a revolution speed of 1,000–30,000 rpm, preferably 5,000–20,000 rpm. The dispersing time is generally from 0.1 to 5 minutes in the case of a batch type dispersing device. The dispersing step is generally performed at 0° to 150° C. (under a pressurized condition), and preferably 40° to 98° C.

3) Simultaneous with the preparation of the ingredient emulsion, the addition of amines and the reaction with the prepolymer having an isocyanate group are performed.

This reaction is accompanied by crosslinking and/or extension of molecular chains. The time for the reaction is generally from 10 minutes to 40 hours, and preferably from 2 to 24 hours, although it depends on the reactivity of the functional groups in the prepolymer such as isocyanate group, and the polyvalent compounds, such as the amines.

The reaction temperature is generally in the range from 0° to 150° C., preferably from 40° to 98° C. In addition, a known catalyst, such as dibutyltin laurate or dioctyltin laurate may be used, where applicable.

4) Upon completion of the reactions, removal of the organic solvent, rinsing, and drying the resulting emulsified dispersion are performed in order to obtain starting toner particles. In order for the solvent to be removed, the entire reactor is gradually heated, while stirring, to form the contents in a layered flow, subjected to intense stirring at a predetermined range of temperature. The solvent is then removed, resulting in starting toner particles being formed with a spindle shape.

In the case when a dispersing agent material soluble in acidic and alkaline media, is used such as calcium phosphate salt, for example, the removal of the dispersing agent is performed by resolving into an acid, such as hydrochloric acid, and by rinsing with water. This removal may also be carried out through decomposition by enzyme and other similar agent.

5) Thereafter, the thus formed starting toner particles are subjected to mixing with fine particles of charge controlling agent and several external additives, such as silica, titanium oxide, and other similar materials, and a mechanical force is applied to the mixture. These particulates are then fixed and unified with the surfaces of the toner particles, to form toner particles. The methods for fixing these particulates are well known, using an appropriate mixer and others, for example.

After these forming process steps, toner particles are obtained with relative ease each having a small diameter and a sharp size distribution.

In addition, the shape of toner particles can be controlled ranging from sphere to spheroid by intensively stirring during the step of organic solvent removal. Further, the surface morphology of the toner particles can also be controlled ranging from smooth to corrugated.

The shape of the toner is approximately spherical according to the embodiment disclosed herein in the present invention and is represented by the shape factors which are detailed herein below.

Figure 11A:
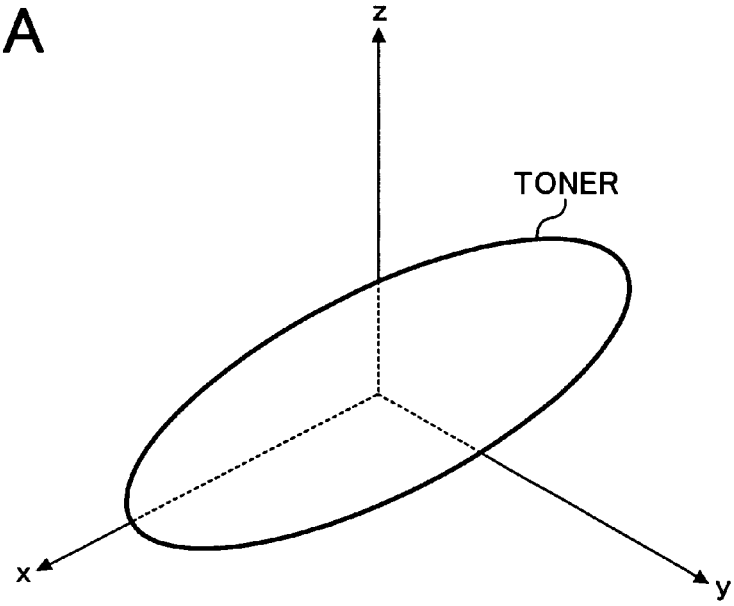
FIGS. 11A, 11B and 11C illustrate the approximate ellipsoidal shape of a toner according to one embodiment disclosed herein.
Figure 11B:
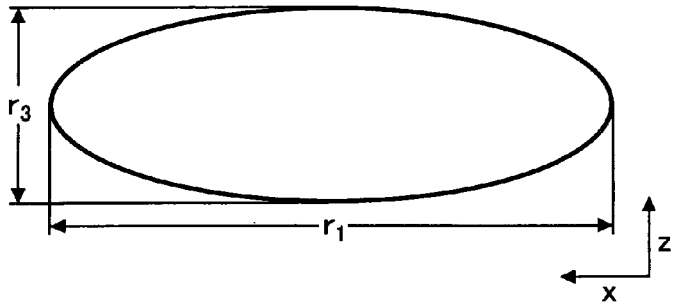
Figure 11C:
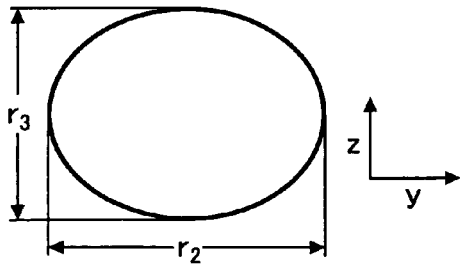

FIGS. 11A, 11B, and 11C diagrammatically illustrate the shape of the toner.

In reference to the drawings, if the approximately elliptical shape of the toner is represented by the major axis having a length r1, the minor axis having a length r2, and the thickness r3 (r1≧r2≧r3), the toner according to the present embodiment preferably has the ratio r2/r1 ranging between 0.5 and 1.0 (FIG. 11B), and the ratio r3/r2 ranging between 0.7 and 1.0 (FIG. 11C).

For r2/r1 values of 0.5 or less, the particle shape deviates from spherical, whereby dot reproducibility and transfer efficiency decreases and a high image quality becomes unfeasible. In addition, for r3/r2 values of 0.7 or less, the shape becomes more flattened and the high transfer efficiency attained with the spherical shape now becomes unfeasible.

For a r3/r2 ratio of 1.0, in particular, the toner becomes an ellipsoid in shape, having the major axis as one of the axes of rotation, whereby the fluidity of toner can be improved.

The parameters r1, r2 and r3 for describing the shapes of the toner in the present embodiment were obtained through the observations from various viewing angles by an SEM (scanning electron microscope).

It is apparent from the above description, including the examples disclosed, that the units, apparatuses, and toner materials disclosed herein have several advantages over those previously known.

Since some of the advantages have been described earlier in each section for respective embodiments, several relevant points will be supplemented herein below.

In one embodiment disclosed herein, a belt fixing unit is provided, comprising a fixing roller, a heating roller, a fixing belt, and a pressing roller disposed in contact with the fixing roller to form a fixing nip having the fixing belt intervening in between, in which the fixing belt includes at least a base member formed of a heat-resisting resin having thickness of 90 μm or smaller, the fixing belt experiencing a tensile force of 0.49 N/mm or less. In addition, the heating roller has a diameter equal to, or larger than that of one of the fixing roller and other belt supporting members.

With the present construction of the belt fixing unit, the adherence of the fixing belt to the heating and other supporting rollers can be ensured. As a result, an undesirable deformation of the fixing belt and concomitant partial underdevelopment of electrophotographic images can be obviated.

As to the toner disclosed herein, this toner is a low melting point toner formed by subjecting a toner preparatory solution, which contains at least a prepolymer having a functional group containing a nitrogen atom, a polyester, a colorant and a releasing agent dispersed in an organic solvent, to extension and/or crosslinking reactions in an aqueous medium. With the present toner, the heat conduction to the fixing belt is improved and the energy-saving feature of the image forming apparatus as a whole can be retained.

Being provided with advantageous features, the belt fixing unit, image forming apparatus incorporating the fixing unit, and the toner material in the fixing unit, according to embodiments disclosed herein, can therefore be suitably utilized in the image forming apparatus making use of electrophotography and electrostatic recording among others.

The process steps set forth in the present description on the belt fixing unit may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

Obviously, additional modifications and variations of the present invention are possible in light of the above teachings. It is therefore to be understood that within the scope of the appended claims, the invention may be practiced otherwise than as specifically described herein.

What is claimed is:

1. A belt fixing unit for use in an image forming apparatus, comprising:

a fixing roller;

a fixing belt disposed around said fixing roller and acted upon by a tensile force of 0.49 N/mm or less; and a pressing roller disposed in contact with said fixing roller to form a fixing nip having said fixing belt intervening there between.

2. The belt fixing unit of claim 1, further comprising:

a base member formed of a heat-resisting resin having a thickness of 90 μm or less.

3. The belt fixing unit according to claim 2, further comprising:

a heating roller housing therein a heat source; and at least one belt supporting member, wherein said heating roller has a diameter equal to, or larger than a diameter of said fixing roller or a diameter of said at least one belt supporting member.

4. An image forming apparatus, comprising:

a belt fixing unit, comprising:

a fixing roller, a heating roller housing therein a heat source and at least one belt supporting member, said heating roller having a diameter equal to, or larger than a diameter of said fixing roller or a diameter of the said at least one belt supporting member, and a fixing belt being disposed around the fixing roller, the fixing belt comprising at least a base member formed of a heat-resisting resin having a thickness of 90 μm or smaller, and being acted upon by a tensile force of 0.49 N/mm or less, and a pressing roller disposed in contact with said fixing roller to form a fixing nip having said fixing belt intervening there between; and a developing unit for developing a latent image into a toner image using a toner.

5. The image forming apparatus of claim 4, wherein said toner is a low-melting point toner formed by subjecting a toner preparatory solution to an extension reaction in an aqueous medium, a crosslinking reaction in an aqueous medium, or a combination thereof, and said toner preparatory solution comprises at least a prepolymer having a functional group containing a nitrogen atom, a polyester, a colorant, and a releasing agent dispersed in an organic solvent.

6. The image forming apparatus according to claim 5, wherein said toner has a volume-averaged particle diameter, Dv, ranging from about 3 to 8 μm and a ratio Dv/Dn ranging from about 1.00 to 1.40, where Dn is a number-averaged particle diameter of the toner.

7. The image forming apparatus according to claim 5, wherein a first shape factor, SF-1, of said toner ranges from about 100 to about 180 and a second shape factor, SF-2, ranges from about 100 to about 180, SF-1 and SF-2 being defined by the expressions:

$$SF\text{-}1=\{(MXLNG)^2/\text{AREA}\}\times 100\pi/4, \text{ and}$$

$$SF\text{-}2=\{(PERI)^2/\text{AREA}\}\times 100\pi/4,$$

where MXLNG, AREA, and PERI are a maximum diameter, an area, and a perimeter of a two-dimensional projection image of said toner, respectively.

8. The image forming apparatus according to claim 5, wherein said toner is approximately spherical in shape.

9. The image forming apparatus according to claim 5, wherein a shape of said toner is approximately an ellipsoid having a major axis with a length r1, a minor axis with a length r2, and a thickness r3, and wherein further r1≧r2≧r3, a ratio r2/r1 ranges from about 0.5 to about 1.0, and a ratio r3/r2 ranges from about 0.7 to about 1.0.

10. The image forming apparatus of claim 4, wherein a first shape factor, SF-1, of said toner is in a range from about 100 to about 180, SF-1 being defined by the expression:

$$SF\text{-}1=\{(MXLNG)^2/\text{AREA}\}\times 100\pi/4,$$

where MXLNG and AREA are a maximum diameter and an area of a two-dimensional image of said toner, respectively.

11. The toner of claim 10, wherein a second shape factor, SF-2, of said toner is in a range from about 100 to about 180, SF-2 being defined by the expression:

$$SF\text{-}2=\{(PERI)^2/\text{AREA}\}\times 100\pi/4,$$

where PERI is a perimeter of the image projection.

12. The image forming apparatus of claim 4, wherein a shape of said toner is approximately an ellipsoid having a major axis with a length r1, a minor axis with a length r2, and a thickness r3.

13. The toner of claim 12, wherein r1≧r2≧r3.

14. The toner of claim 13, wherein a ratio r2/r1 ranges from about 0.5 to about 1.0.

15. The toner of claim 14, wherein a ratio r3/r2 ranges from about 0.7 to about 1.0.

16. The image forming apparatus of claim 4, wherein said toner is a low-melting point toner formed by subjecting a toner preparatory solution to an extension reaction in an aqueous medium, a crosslinking reaction in an aqueous medium, or a combination thereof, and said toner preparatory solution comprises at least a prepolymer having a functional group containing a nitrogen atom, a polyester, a colorant, and a releasing agent dispersed in an organic solvent.

17. A belt fixing unit for use in an image forming apparatus, comprising:

a first roller;

a second roller;

belt means for fixing an image in the image forming apparatus, said belt means comprising at least a base member formed of a heat-resisting resin having a thickness of 90 μm or smaller, and being acted upon by a tensile force of 0.49 N/mm or less; and a third roller disposed in contact with said first roller to form a fixing nip having said belt means intervening there between.

18. The belt fixing unit according to claim 17, wherein said belt means is disposed around said first roller in order to form said fixing nip, said second roller has a heat source therein and at least one belt means supporting member, and said second roller has a diameter equal to, or larger than a diameter of said first roller or a diameter of said at least one of belt means supporting member.

19. An image forming apparatus, comprising:

a belt fixing unit, comprising:

a first roller;

a second roller;

belt means for fixing an image in the image forming apparatus, said belt means comprising at least a base member formed of a heat-resisting resin having a thickness of 90 μm or smaller and acted upon by a tensile force of 0.49 N/mm or less; and a third roller disposed in contact with said first roller with having said belt means intervening therebetween, wherein said second roller houses therein a heat source and at least one belt means supporting member and has a diameter equal to, or larger than that of said first roller or said at least one belt means supporting member; and means for developing a latent image into a toner image using a toner, wherein said toner is a low-melting point toner formed by subjecting a toner preparatory solution to an extension reaction in an aqueous medium, a crosslinking reaction in an aqueous medium, or a combination thereof, and said toner preparatory solution comprises at least a prepolymer having a functional group containing a nitrogen atom, a polyester, a colorant and a releasing agent dispersed in an organic solvent.

* * * * *